US005837434A

United States Patent [19]

Roussilhe et al.

[11] Patent Number: 5,837,434

[45] Date of Patent: Nov. 17, 1998

[54] PHOTOGRAPHIC DEVELOPERS CONTAINING A DEVELOPING AGENT OF THE ASCORBIC ACID TYPE AND AN ACCELERATOR

[75] Inventors: Jacques Roussilhe, Virey Le Grand, France; Siu-Chung Tsoi, Hertfordshire, England

[73] Assignee: Eastman Kodak Company, Rochester, N.Y.

[21] Appl. No.: 936,406

[22] Filed: Sep. 25, 1997

[30] Foreign Application Priority Data

Sep. 25, 1996 [FR] France ..... 9611958

[51] Int. Cl.[6] ..... G03C 5/30

[52] U.S. Cl. ..... 430/480; 430/440; 430/446; 430/483; 430/487

[58] Field of Search ..... 430/480, 483, 430/487, 440, 446

[56] References Cited

U.S. PATENT DOCUMENTS

| | | | |
|---|---|---|---|
| 4,266,002 | 5/1981 | McCreary et al. | 430/218 |
| 5,474,879 | 12/1995 | Fitterman et al. | 430/487 |

FOREIGN PATENT DOCUMENTS

| | | |
|---|---|---|
| 0 034 038 | 2/1980 | European Pat. Off. . |
| 0 533 182 A1 | 9/1991 | European Pat. Off. . |
| 0 628 878 A1 | 12/1994 | European Pat. Off. . |
| 55-17158 | 2/1980 | Japan . |

*Primary Examiner*—Hoa Van Le
*Attorney, Agent, or Firm*—J. Lanny Tucker

[57] ABSTRACT

The invention concerns a developer solution for processing silver halide photographic products. This developer solution contains an ascorbic acid developing agent, a auxiliary developing agent which is a substituted phenidone and a development accelerator which is a thioether having an ammonium group, a triazolium thiolate or a substituted thioalkane.

9 Claims, No Drawings

PHOTOGRAPHIC DEVELOPERS CONTAINING A DEVELOPING AGENT OF THE ASCORBIC ACID TYPE AND AN ACCELERATOR

FIELD OF THE INVENTION

The invention concerns the development of photographic products and, in particular, the use for this purpose of ascorbic acid developers in the presence of development accelerators.

BACKGROUND OF THE INVENTION

The development of photographic (or radiographic) products, notably in black and white, is carried out with a developer which is an aqueous alkaline composition containing a developing agent.

Developing agents are described in Chimie et *Physique Photographiques*, P. Glafkides, Chapter IX, pages 152–170, fifth edition. In general a main developing agent is used in association with an auxiliary developing agent. In certain cases, a synergetic effect is observed between the main developing agent, referred to hereinafter as the "developing agent", and the auxiliary developing agent. IN other words, the combined activity of the mixture of these two agents is greater than the sum of the activities of each of these agents used separately in the same solution. This phenomenon, called "superadditivity", is explained in Mason, "*Photographic Processing Chemistry*", Focal Press, London, 1975.

Polyphenols, for example hydroquinone, and reductones, for examples compounds of the ascorbic acid type, are the most widely used developing agents in practice in black and white developers.

Developers based on hydroquinone generally yield good results but require alkaline pH. Ascorbic acid has been recommended in place of hydroquinone in association with phenidones in developing compounds described in numerous patents.

Amongst these, U.S. Pat. No. 5,098,819 describes a developing compound comprising ascorbic acid or one of its derivatives, and a 3-pyrazolidinone. The developer in the examples contains sodium erythorbate, Phenidone or Dimezone-S and potassium carbonate.

The most frequently used auxiliary developing agents are the compounds of the 3-pyrazolidinone type, or phenidones. These phenidones have an insufficient solubility in water, which is a handicap both with regard to the production of the developer and to its use. However, as a result of the introduction of solubilizing groups in phenidones, the association of such solubilized phenidones with the main developing agent can become less effective.

Ascorbic acid developers are sensitive to oxidation. This oxidation is probably catalyzed by metallic ions (G. Haist, "Modern Photographic Processing", John Wiley & Sons, N.Y., 1979). By adjusting the development times, the geometry of the processing tanks or the formula of the developers, it is possible, given ideal conditions which minimize oxidation, to obtain sensitometric results comparable to those obtained with hydroquinone developers. However, to obtain the desired Dmax values, longer development times are necessary. Consequently, films developed with an ascorbic acid developer in rapid processing conditions (for example with a development time of 15 seconds for a total processing sequence lasting 45 seconds) yield lower speed, contrast and Dmax values. It is possible to use development accelerators. Such compounds are described in "Photographic Processing Chemistry", Focal Press, London, 1975. However, these compounds are not desirable with ascorbic acid developers as, whilst reinforcing the excessively low sensitometric characteristics, they cause Dmin to increase.

SUMMARY OF THE INVENTION

The present invention concerns a developer characterized by the association of a developing agent of the ascorbic acid type, an auxiliary developing agent of the 3-pyrazolidinone type with solubilizing groups and a development accelerator enabling the aforementioned drawbacks to be remedied.

The present invention also concerns a method for obtaining a photographic image from a photosensitive silver halide product, said method using the aforementioned developer.

The developer solution according to the invention is an aqueous alkaline hydroquinone-free composition for the development of photographic silver halides comprising a first developing agent that is an ascorbic acid, an auxiliary developing agent of the 1-phenyl-3-pyrazolidinone type and at least one development accelerator, wherein:

(I) the auxiliary developing agent has the formula:

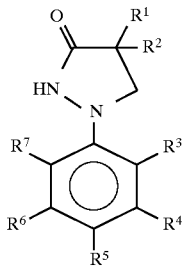

(I)

wherein $R^1$ to $R^7$ in formula (I) each separately represent hydrogen, an alkyl group, a substituted or non-substituted alkoxy group, substituted or non-substituted aryloxy group, or a group represented by the formula:

$(X)_p$—A-(Sol)

wherein p is 0 or 1; X represents a divalent group chosen from —O—, —S—and —$NR^8$—, wherein $R^8$ is H, alkyl or A-(Sol); A represents a divalent group chosen from

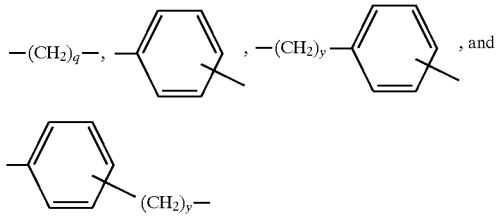

wherein q is between 0 and 5, and y is between 1 and 3; (Sol) is a solubilizing group chosen from: $CO_2H$, $SO_3H$, $NHSO_2R^{10}$, $SO_2NH_2$, $SO_2NHR^{10}$, polyhydroxyalkyl,

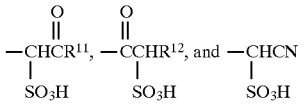

wherein $R^{10}$ is an alkyl or aryl, $R^{11}$ is OH, an alkyl or aryl and $R^{12}$ is hydrogen, an alkyl or aryl;

with the additional conditions that (a) at least one of the radicals $R^1$ to $R^7$ must contain a (SOL) group, and (b) A can represent a covalent bond, (II) the development accelerator is selected from the class comprising:

(a) thioethers having at least one ammonium group (b) triazolium thiolates, and (c) substituted thioalkanes.

DETAILED DESCRIPTION OF THE INVENTION

According to a preferred embodiment, the development accelerator has the formula:

$$R^{10}R^{11}R^{12}N+(R^{13}S)_rR^{14}QX^-$$

wherein $R^{10}$, $R^{11}$, $R^{12}$ each independently represent an alkyl, aryl, aralkyl or alkaryl group, substituted or not, or two of the groups $R^{10}$–$R^{12}$ form with the nitrogen atom a quaternary cyclic ring, $R^{13}$, $R^{14}$ each represent an alkylene group, Q represents hydrogen or a $+NR^{10}R^{11}R^{12}$ group, r is a number between 1 and 10 inclusive, and X− is an anion.

According to another embodiment, the development accelerator has the formula:

$$R^{10}R^{11}R^{12}+N(CH^2CH^2S)_sCH^2CH^2+NR^{10}R^{11}R^{12}X^-$$

wherein s is 1, 2 or 3, $R^{10}$, $R^{11}$, $R^{12}$ and X are as defined above.

According to still another embodiment, the development accelerator has the formula:

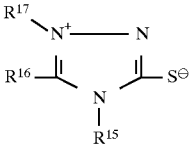

wherein $R^{15}$, $R^{16}$, $R^{17}$ each separately represent an alkyl group with 1 to 10 carbon atoms, an aryl group with 6 to 10 carbon atoms, an aralkyl group, an alkaryl group or a cycloalkyl group with 5 to 10 carbon atoms.

According to another embodiment, the development accelerator has one of the formulae:

$$R^{18}—(CH_2)_t—S—(CH_2)_t—R^{19}$$

$$R^{18}—(CH_2)_t—S—(CH_2)_u—S—(CH_2)_t—R^{19}$$

$$R^{18}—(CH_2)_t—S—(CH_2)_u—O—(CH_2)_u—S—(CH_2)_t—R^{19}$$

$$R^{18}—(CH_2)_t—S—(CH_2)_u—O—(CH_2)_u—O—(CH_2)_u—S—(CH_2)_t—R^{19}$$

wherein t is between 1 and 12, preferably between 2 and 6, u is between 1 and 6, preferably 2, and $R^{18}$ and $R^{19}$ each independently represent:

$$—OH,\ —CONHEt,\ —CONHCH_2CH_2OH,$$

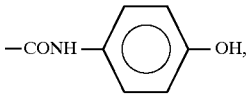

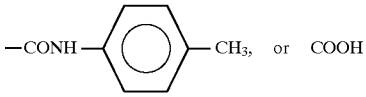

Examples of such development accelerators are:

$HO—CH_2CH_2—S—CH_2CH_2—OH$, $HO—CH_2CH_2—S—CH_2CH_2—S—CH_2CH_2OH$, $HO—CH_2CH_2—S—CH_2CH_2CH_2OH$, $HO—CH_2CH_2—S—CH_2CH_2—O—CH_2CH_2SCH_2CH_2OH$, $HO—(CH_2)_6—S—CH_2CH_2—O—CH_2CH_2—O—CH_2CH_2—O—CH_2CH_2—S—(CH_2)_6—OH$, $HO—(CH_2)_6—S—CH_2CH_2—O—CH_2CH_2—O—CH_2CH_2—O—CH_2CH_2—S—CH_2CH_2—OH$, $HO—(CH_2)_6—S—CH_2CH_2—O—CH_2CH_2—S—(CH_2)_6—OH$, $EtNH—CO—(CH_2)_5—S—CH_2CH_2—O—CH_2CH_2—S—(CH_2)_5—CO—NH—Et$, and $EtNH—CO—(CH_2)_5—S—CH_2CH_2—O—CH_2CH_2—O—CH_2CH_2—O—CH_2CH_2—S—(CH_2)_5—CO—NHEt$ Useful development accelerators are described in more detail in Fitterman et al U.S. Pat. No. 5,474,879.

The development accelerator can be used alone, in a mixture, or in combination with other monomeric or polymeric accelerating agents as described in aforementioned Mason, pages 41–44. The amount of accelerator in the developer is in the range of from 0.01 to 1.0 g per liter of developer solution, preferably from 0.05 to 0.5 g/l.

The developer solution according to the invention comprises:

1. an ascorbic acid developing agent;
2. a co-developer of the 1-phenyl-3-pyrazolidinone type substituted by at least one solubilizing group; and
3. a development accelerator as defined above.

The developer solution can also contain an antioxidant, a sequestering agent, a buffer agent, an antifoggant, a solvent, a surfactant, and other additives usually present in such compositions. Developer solutions containing ascorbic acid have little tendency to form silver sludge or to cause metallic silver to be deposited on the equipment. Nevertheless, the developer can also contain an anti-sludge agent that prevents the formation of sludges and deposits.

In the present specification, the term "ascorbic acid " comprises L-ascorbic acid, D-isoascorbic acid, D-glucoascorbic acid, L-erythroascorbic acid, sodium isoascorbate, L-glycoascorbic acid, D-galactoascorbic acid and other derivatives known in the art. The concentration of the ascorbic acid is between 0.8 and 4% by weight in relation to the weight of the developer solution.

The term "hydroquinone-free" means that the developer solution is substantially free of developing agents of the polyhydroxybenzene type such as hydroquinone.

The 1-phenyl-3-pyrazolidinone auxiliary developing agent has a solubilizing substituent having a nature and a location as defined herein. Preferably, this auxiliary developing agent corresponds to formula I above, wherein $R^1$ and $R^2$ each separately represent hydrogen, a substituted or non-substituted alkyl group; or an A—$(X)_p$—A-Sol group; $R^3$ to $R^7$ in formula (I) each separately represent hydrogen, an alkyl group, a substituted or non-substituted alkoxy group or substituted or non-substituted aryloxy group or a group represented by the formula:

(X)p—A-(Sol)

wherein p is 0 or 1; X represents a divalent group chosen from

—O—, —S—, —$NR^8$— wherein $R^8$ is H, an alkyl or A-(Sol); A and A' represent identical or different divalent groups chosen from

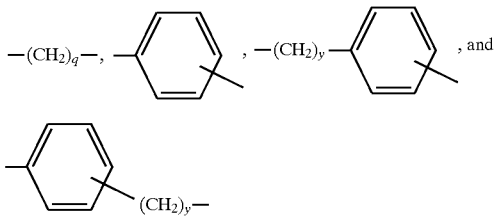

wherein q is between 0 and 5, and y is between 1 and 3; (Sol) is a solubilizing group chosen from: $CO_2H$, $SO_3H$, $NHSO_2R^{10}$, $SO_2NH_2$, $SO_2NHR^{10}$, polyhydroxyalkyl,

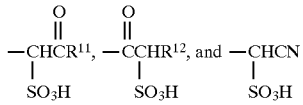

wherein $R^{10}$ is an alkyl or aryl, $R^{11}$ is OH, an alkyl or aryl and $R^{12}$ is hydrogen, an alkyl or aryl;

with the additional conditions that (a) at least one of the radicals $R^1$ to $R^7$ must contain a (SOL) group, (b) A can represent a covalent bond.

In preference, this auxiliary developing agent has at least one solubilizing group not directly fixed to the phenyl ring. Suitable auxiliary developing agents have, for example, one of the following formulae:

(I)

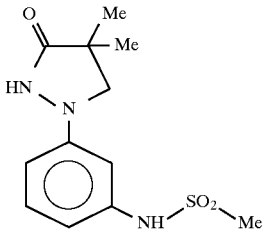

-continued (II)

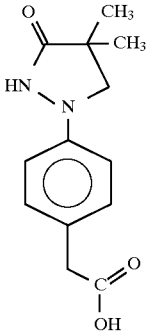

(III)

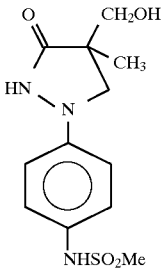

(IV)

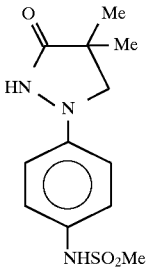

(V)

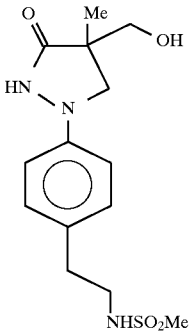

(VI)

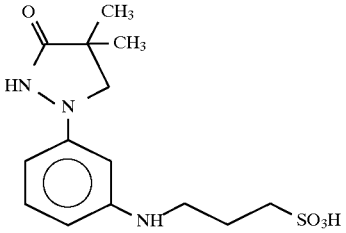

-continued (VII)

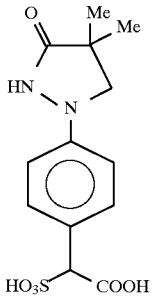

(VIII)

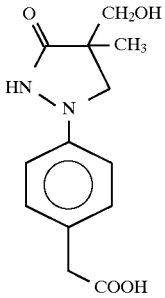

(IX)

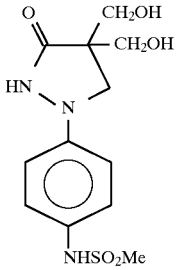

(X)

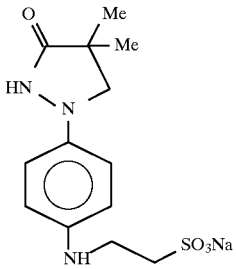

(XI)

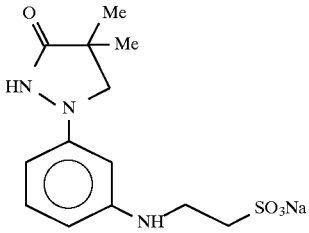

(XII)

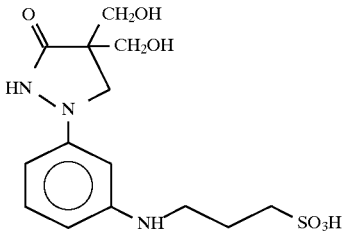

-continued (XIII)

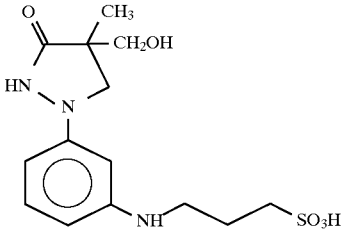

(XIV)

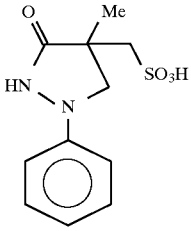

(XV)

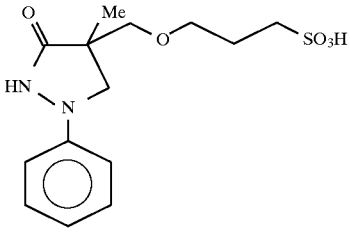

The developer solution of this invention contains from 0.1 to 1.0% by weight of auxiliary developing agent based on the total weight of the solution.

The developer solution can contain an antioxidant which is a sulfite or a compound capable of providing sulfite ions in aqueous solution. The antioxidant can thus be a sulfite, a bisulfite, a metabisulfite or a bisulfitic aldehyde compound. For example, salts of alkaline metals or ammonium such as sodium sulfite, potassium sulfite, sodium bisulfite, potassium bisulfite, sodium metabisulfite, potassium bisulfite or ammonium metabisulfite are used. The quantity of sulfite ions in the solution must be greater than 0.03 mol/l of developer and in general between 0.10 and 0.80 mol/l.

A buffer or an agent capable of influencing the pH can also be used, for example a carbonate, boric acid or a boric acid salt, or an alkanol amine.

The substances on which a sequestering agent can act are calcium, iron or copper ions. Calcium ions, in particular, can cause a precipitation in the developer solution and thus the formation of contaminant particles. Other metallic traces can promote the decomposition of the developing agent. Phosphates, hydroxy acids or nitrous polycarboxylic acids of the ethylenediaminetetraacetic acid type can be used as sequestering agents. The amount of sequestering agent present in the solution is generally from 0.1 to 1.0% by weight.

The anti-fog agents are well-known compounds; they serve to prevent the formation of fog during development. The most usual anti-fog agents are compounds of the benzimidazole, benzotriazole, mercaptoazole, indazole or mercaptothiadiazole type. The amount of anti-fog agent present in the developer solution is in generally from 0.001 to 0.1% by weight.

The developer solution according to the invention is prepared by dissolving the constituents in water, then adjusting the pH to the desired value. It is also possible to prepare the solution in a concentrated form, to be diluted to the working concentration just before use. A variant of this last embodiment consists of preparing several concentrates, each containing one or more of the constituents of the developer, and then mixing these concentrates and diluting the mixture just before use.

The developer solution can be used with an automatic processing machine such as the Kodak X-OMAT machines for processing radiographic films. The use of concentrated solutions to be diluted before use is particularly recommended with automatic processing machines. It is also possible to use constituents in solid form, such as powders, granules or tablets, to be dissolved to the desired concentration before use. These constituents can thus be stored separately in a form and packaging offering satisfactory stability.

According to another embodiment, the development accelerator can be incorporated in one or more layers of photographic product, for example in an intermediate layer adjacent to a layer of photosensitive emulsion. In this case the quantity of accelerator is between 0.00005 and 0.01 $g/m^2$.

The following examples illustrate the invention. In these examples, samples of Kodak T-MAT G or T-MAT G/RA radiographic films are exposed in different developers and the sensitometric results obtained are compared. Each sample is processed at a temperature of 20° C. for 3 minutes, conditions aimed at simulating rapid processing in a machine at 35°.

The following composition is used as a control developer:

ascorbic acid 32 g
potassium sulfite 50 g
potassium carbonate 100 g
co-developer (1) 2.5 g
benzotriazole 0.2 g
diethylenetriaminepentaacetic acid 1.7 g
potassium bromide 4 g sufficient water to make up 1 liter pH 10.2

(1) 4-hydroxymethyl-4-methyl-1-phenyl-3-pyrazolidinone

EXAMPLES 1–3

Samples of T-MAT G radiographic film are processed in, respectively:

(1) the control developer (2) the control developer, in which the auxiliary developing agent is replaced with the compound below;

(3) the developer of (2), to which the accelerator below (0.4 g/l) and phenylmercaptotetrazole (0.02 g/l) have been added.

Each sample is developed for 3 minutes at 20° C.

EXAMPLES 4–6

The method of the preceding examples is used, with samples of T-MAT G/RA radiographic film being processed in, respectively:

(4) the control developer (5) the control developer, in which the auxiliary developing agent is replaced with the compound below (6) the developer of (5), to which the accelerator below (0.4 g/l) and phenylmercaptotetrazole (0.02 g/l) have been added.

The auxiliary developing agent

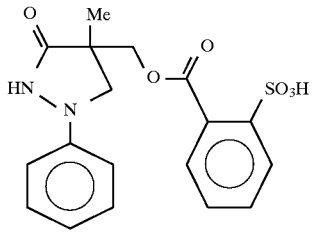

Accelerator

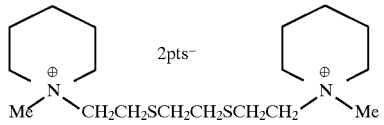

The results are compiled in the following table:

TABLE 1

| Example | Film | Dmin | Dmax | Sensitivity | Contrast |
|---|---|---|---|---|---|
| 1 | T-MAT G | 0.25 | 3.56 | 436.2 | 3.04 |
| 2 | T-MAT G | 0.23 | 3.64 | 434.8 | 3.17 |
| 3 | T-MAT G | 0.23 | 3.21 | 442.4 | 3.14 |
| 4 | T-MAT G/RA | 0.23 | 3.79 | 441.0 | 3.39 |
| 5 | T-MAT G/RA | 0.22 | 3.72 | 438.5 | 3.41 |
| 6 | T-MAT G/RA | 0.24 | 3.41 | 447.7 | 3.54 |

EXAMPLES 7–11

The method of the preceding examples is repeated, with samples of T-MAT G/RA radiographic film being processed in, respectively:

(7) the control developer;

(8) the control developer, in which the auxiliary developing agent has the formula (A) below;

(9) the developer of (8), to which the accelerator below (0.05 g/l) and phenylmercaptotetrazole (0.005 g/l) have been added;

(10) the control developer, in which the auxiliary developing agent has the formula (B) below;

(11) the developer of (10), to which the accelerator below (0.1 g/l) and phenylmercaptotetrazole (0.015 g/l) have been added.

Auxiliary developing agent (A)

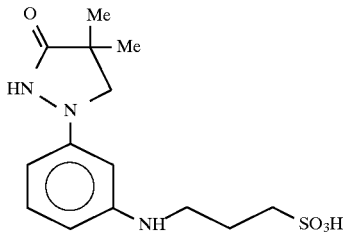

-continued

Auxiliary developing agent (B)

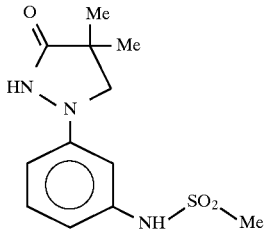

Accelerator

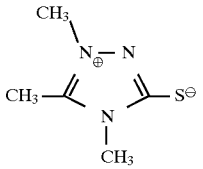

The results are compiled in the following table:

TABLE 2

| Example | Film | Dmin | Dmax | Sensitivity | Contrast |
|---|---|---|---|---|---|
| 7 | T-MAT G/RA | 0.20 | 3.77 | 447.3 | 3.19 |
| 8 | T-MAT G/RA | 0.18 | 3.79 | 436.5 | 3.60 |
| 9 | T-MAT G/RA | 0.20 | 3.57 | 449.3 | 3.50 |
| 10 | T-MAT G/RA | 0.18 | 3.98 | 427.5 | 3.68 |
| 11 | T-MAT G/RA | 0.26 | 3.52 | 450.8 | 3.54 |

EXAMPLES 12–15

The method of the preceding examples is repeated, with samples of T-MAT G/RA radiographic film being processed, respectively, in the following developers:

(12) the control developer

(13) the control developer, in which the auxiliary developing agent has been replaced with the compound below;

(14) the developer of (13), to which an accelerator having the formula (C) below (0.4 g/l) and phenylmercaptotetrazole (0.01 g/l) have been added;

(15) the developer of (13), to which an accelerator having the formula (D) below (0.1 g/l) and phenylmercaptotetrazole (0.01 g/l) have been added.

Auxiliary developing agent

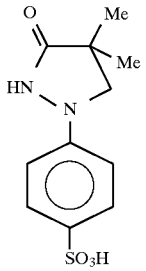

-continued

Development accelerator (C)

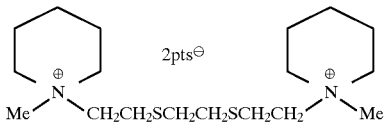

Development accelerator (D)

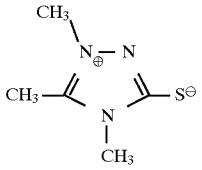

The results are compiled in the following table:

TABLE 3

| Example | Film | Dmin | Dmax | Sensitivity | Contrast |
|---|---|---|---|---|---|
| 12 | T-MAT G/RA | 0.24 | 3.55 | 452.7 | 3.34 |
| 13 | T-MAT G/RA | 0.22 | 3.74 | 436.5 | 4.32 |
| 14 | T-MAT G/RA | 0.23 | 3.15 | 459.8 | 5.76 |
| 15 | T-MAT G/RA | 0.23 | 3.18 | 454.4 | 4.04 |

EXAMPLES 16–18

The method of the preceding examples is repeated, with samples of radiographic film being processed, respectively, in the following developers:

(16) the control developer

(17) the control developer, in which the auxiliary developing agent is replaced with the compound below;

(18) the developer of (17), to which an accelerator with the formula below (0.1 g/l) and phenylmercaptotetrazole (0.02 g/l) have been added.

Auxiliary developing agent

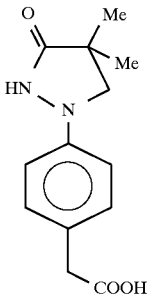

Accelerator

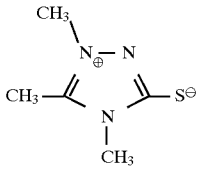

The results are compiled in the following table:

TABLE 4

| Example | Film | Dmin | Dmax | Sensitivity | Contrast |
|---|---|---|---|---|---|
| 16 | T-MAT G/RA | 0.25 | 3.73 | 442.8 | 3.12 |
| 17 | T-MAT G/RA | No significant sensitometric results | | | |
| 18 | T-MAT G/RA | 0.20 | 3.35 | 432.1 | 4.14 |

EXAMPLES 19–21

The method of the preceding examples is repeated, with samples of T-MAT G/RA radiographic film being processed in, respectively, the following developers:

(19) a control developer (19) having the composition below;

(20) a control developer (20) having the composition below, in which the auxiliary developing agent (HMMP) has been replaced with the compound (E) below;

(21) the developer (20), to which an accelerator having the formula (F) below (0.025 g/l) and phenylmercaptotetrazole (0.0075 g/l) have been added.

| | Control developer (19) | Control developer (20) |
|---|---|---|
| $FeSO_4$ | 0.10 | 0.10 |
| EDTA | 0.225 | 0.225 |
| Ascorbic acid | 0.26 | 0.26 |
| HMMP* | 0.005 | — |
| Auxiliary developing agent (F) | — | 0.005 |
| KBr | 0.08 | 0.08 |
| pH | 10 | 10 |

*4-hydroxymethyl-4-methyl-Phenidone
All quantities are in mol/l
Auxiliary developing agent (E)

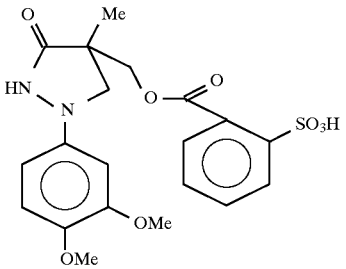

Development accelerator (F)

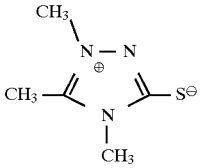

The results are compiled in the following table:

TABLE 5

| Example | Film | Dmin | Dmax | Sensitivity | Contrast |
|---|---|---|---|---|---|
| 19 | T-MAT G/RA | 0.20 | 3.64 | 440.8 | 23.37 |
| 20 | T-MAT G/RA | 0.21 | 3.61 | 437.4 | 3.19 |
| 21 | T-MAT G/RA | 0.21 | 3.63 | 444.5 | 3.13 |

EXAMPLES 22–27

The method of the preceding examples is repeated, with samples of T-MAT G/RA radiographic film being processed in, respectively, the following developers:

(22) a control developer identical to that of Example 1;

(23) the control developer, in which the auxiliary developing agent has the formula (G) below;

(24) the developer (23), to which an accelerator having the formula (H) below (0.15 g/l) has been added;

(25) the developer (23), to which an accelerator having the formula (J) below (0.4 g/l) has been added;

(26) the developer (23), to which an accelerator having the formula (K) below (0.2 g/l) has been added);

(27) the developer (23), to which an accelerator having the formula (L) below (0.1 g/l), phenylmercaptotetrazole (0.0025 g/l) and BTAZ (0.2 g/l) have been added.

Auxiliary developing agent (G)

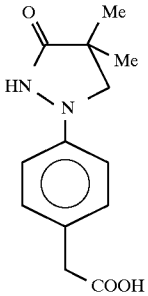

Accelerator (H)
$HO(CH_2)_6SCH_2CH_2OCH_2CH_2OCH_2CH_2S(CH_2)_6OH$
Accelerator (J): trimethylammonium [3-(decylthio-2-hydroxypropyl] para-toluenesulfonate
Accelerator (K)
$HOCH_2CH_2SCH_2CH_2OCH_2CH_2SCH_2CH_2OH$
Accelerator (L)

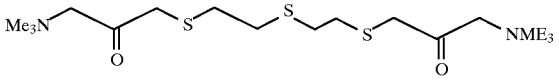

The results are compiled in the following table:

TABLE 6

| Example | Film | Dmin | Dmax | Sensitivity | Contrast |
|---|---|---|---|---|---|
| 22 | T-MAT G/RA | 0.22 | 3.80 | 447.4 | 3.25 |
| 23 | T-MAT G/RA | 0.20 | 3.86 | 435.3 | 3.74 |
| 24 | T-MAT G/RA | 0.23 | 3.58 | 447.7 | 3.39 |
| 25 | T-MAT G/RA | 0.21 | 3.70 | 448.1 | 3.38 |
| 26 | T-MAT G/RA | 0.21 | 3.62 | 446.8 | 3.61 |
| 27 | T-MAT G/RA | 0.23 | 3.52 | 452.6 | 3.30 |

The sensitivity of the radiographic film is inversely proportional to the exposure required to produced a certain effect; in the above examples, the sensitivity is that corresponding to the exposure necessary to produce a density of 1.00 above the "support +fog" value, that is to say the density of the film (layers of emulsion included) in the areas where it has not been exposed.

The contrast corresponds to the slope of the characteristic curve D/Log (E) between the densities 2.00 and 0.25 above the "support +fog" value.

The invention has been described in detail with particular reference to certain preferred embodiments thereof, but it will be understood that variations and modifications can be effected within the spirit and scope of the invention.

We claim:

1. An aqueous developer solution for the development of photographic silver halides, comprising a first silver halide developing agent that is an ascorbic acid, an auxiliary developing agent that is 1-phenyl-3-pyrazolidinone, and at least one development accelerator, wherein:

(I) said auxiliary developing agent has the formula:

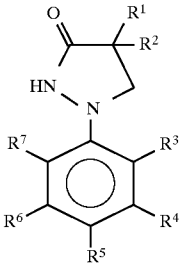

(I)

wherein $R^1$ to $R^7$ in formula (I) each separately represent hydrogen, an alkyl group, a substituted or non-substituted alkoxy group, substituted or non-substituted aryloxy group, or a group represented by the formula:

$$(X)_p—A\text{-}(Sol)$$

wherein p is 0 or 1; X represents a divalent group chosen from $$—O—,\ —S—,\ \text{and}\ —NR^8—$$

wherein $R^8$ is H, an alkyl or A-(Sol); A represents a divalent group chosen from

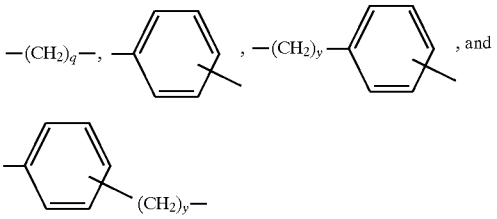

wherein q is between 0 and 5, and y is between 1 and 3; (Sol) is a solubilizing group chosen from:

$CO_2H$, $SO_3H$, $NHSO_2R^{10}$, $SO_2NH_2$, $SO_2NHR^{10}$, polyhydroxyalkyl,

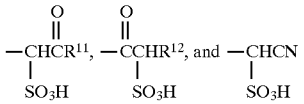

wherein $R^{10}$ is an alkyl or aryl, $R^{11}$ is OH, an alkyl or aryl, and $R^{12}$ is hydrogen, an alkyl or aryl;

with the additional conditions that (a) at least one of the radicals $R^1$ to $R^7$ must contain a (SOL) group, and (b) A can represent a covalent bond, and (II) said development accelerator is selected from the class consisting of:

(a) thioethers having at least one ammonium group (b) triazolium thiolates, and (c) substituted thioalkanes.

2. The developer of claim 1, wherein said auxiliary developing agent has the formula:

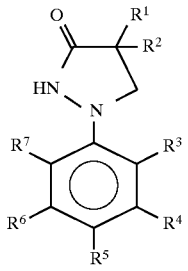

(I)

wherein $R^1$ and $R^2$ each separately represent hydrogen, or a substituted or non-substituted alkyl group, $R^3$ to $R^7$ each separately represent hydrogen, a substituted or non-substituted alkyl group, a substituted or non-substituted alkoxy group, or substituted or non-substituted aryloxy group or a solubilizing group selected from the class consisting of $NR^8—A—SO_3H$, $A—CO_2H$, $NH—SO_2—R^9$ wherein A, $R^8$ and $R^9$ have the signification indicated in claim 1, at least one of the $R^3$–$R^7$ groups representing said solubilizing group.

3. The developer solution of claim 1, wherein said development accelerator has the formula:

$$R^{10}R^{11}R^{12}N^+(R^{13}S)_nR^{14}Q\ X^-$$

wherein $R^{10}$, $R^{11}$, $R^{12}$ each independently represent an alkyl, aryl, aralkyl or alkaryl group, substituted or not, or two of the groups $R^{10}$–$R^{12}$ form with N a quaternary cycle, $R^{13}$, $R^{14}$ each represent an alkylene group, Q represents hydrogen or a $+NR^{10}R^{11}R^{12}$ group, n is a number between 1 and 10 inclusive and X– is an anion.

4. The developer of claim 3 wherein said development accelerator has the formula:

$$R^{10}R^{11}R^{12}+N(CH^2CH^2S)_sCH^2CH^2+NR^{10}R^{11}R^{12}\ X^-$$

wherein s is 1, 2 or 3, $R^{10}$, $R^{11}$, $R^{12}$ and X have the signification indicated in claim 3.

5. The developer of claim 1 wherein said development accelerator has the formula:

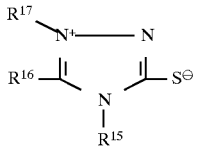

or a tautomeric formula, wherein $R^{15}$–$R^{17}$ each represent an alkyl group with 1 to 10 carbon atoms.

6. The developer of claim 1 wherein said development accelerator has one of the formulae:

$$R^{18}—(CH_2)_t—S—(CH_2)_t—R^{19}$$

$$R^{18}—(CH_2)_t—S—(CH_2)_u—S—(CH_2)_t—R^{19}$$

$$R^{18}—(CH_2)_t—S—(CH_2)_u—O—(CH_2)_u—S—(CH_2)_t—R^{19}, \text{ or}$$
$$R^{18}—(CH_2)_t—S—(CH_2)_u—O—(CH_2)_u—O—(CH_2)_u—S—(CH_2)_t—R^{19}$$

wherein t is between 1 and 12, preferably between 2 and 6, u is between 1 and 6, preferably 2, and $R^{18}$ and $R^{19}$ each independently represent:

$$-OH, \quad -CONHEt, \quad -CONHCH_2CH_2OH,$$

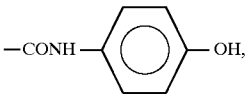

-continued

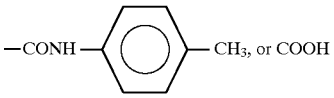

7. The developer of claim 1 wherein the concentration of said ascorbic acid developing agent is between 0.5 and 5% by weight based on the total weight of said developer solution.

8. The developer of claim 1 wherein the concentration of said development accelerator is between 0.01 and 5% by weight based on the total weight of said developer solution.

9. A method for the development of an exposed silver halide photographic material, said method comprising the step of contacting the exposed photographic material with the developer solution of claim 1.

* * * * *